US005390856A

United States Patent [19]

Bickerton

[11] Patent Number: 5,390,856

[45] Date of Patent: Feb. 21, 1995

[54] FUEL INJECTORS FOR DIESEL ENGINES

[75] Inventor: Ronald A. Bickerton, West Sussex, England

[73] Assignee: Ricardo Consulting Engineers Limited, West Sussex, England

[21] Appl. No.: 211,377

[22] PCT Filed: Oct. 9, 1992

[86] PCT No.: PCT/GB92/01845

§ 371 Date: Mar. 30, 1994

§ 102(e) Date: Mar. 30, 1994

[87] PCT Pub. No.: WO93/07377

PCT Pub. Date: Apr. 15, 1993

[30] Foreign Application Priority Data

Oct. 11, 1991 [GB] United Kingdom ..... 9121592

[51] Int. Cl.[6] ..... F02M 43/04; F02M 45/08

[52] U.S. Cl. ..... 239/533.5

[58] Field of Search ..... 239/533.3, 533.4, 533.5, 239/533.9, 93, 95, 570

[56] References Cited

U.S. PATENT DOCUMENTS

| | | | |
|---|---|---|---|
| 3,394,891 | 7/1968 | Voit | 239/533.5 |
| 3,403,861 | 10/1968 | Eidtmann et al. | 239/533.5 |
| 4,258,883 | 3/1981 | Hofmann et al. | 239/533.5 X |
| 4,467,963 | 8/1984 | Sisson et al. | 239/95 X |
| 4,938,193 | 7/1990 | Raufeisse et al. | 239/533.9 X |
| 4,957,085 | 9/1990 | Suerdlin | 239/533.9 X |

*Primary Examiner*—Andres Kashnikow
*Assistant Examiner*—Kevin P. Weldon
*Attorney, Agent, or Firm*—McAulay Fisher Nissen Goldberg & Kiel

[57] ABSTRACT

A fuel injection for use in a diesel engine and adapted to inject two different fuels sequentially comprises a body including an injection nozzle defining one or more injection orifices, a main fuel supply passage and a pilot fuel supply passage which includes a first non-return valve arranged to prevent fuel flowing in it away from the injection nozzle. The nozzle is controlled by a valve needle which affords a surface directed towards the injection orifice(s) and exposed to a fuel supply gallery. The body contains a cylinder which slidably receives a piston. The main fuel passage communicates with the cylinder adjacent one end thereof and the pilot fuel passage communicates with the cylinder adjacent the other end thereof and with a first outlet passage which communicates with the fuel gallery and includes a second non-return valve arranged to prevent fuel flowing from the fuel gallery into the pilot fuel passage. A second outlet passage communicates with the fuel gallery and with the cylinder at a point intermediate its ends, whereby the main fuel passage communicates with the fuel gallery via the cylinder and the second outlet passage when the piston is at the said other end of the cylinder but not when it is at the said one end of the cylinder.

5 Claims, 3 Drawing Sheets

FUEL INJECTORS FOR DIESEL ENGINES

SUMMARY OF THE INVENTION

The present invention relates to fuel injectors for use in diesel engines and is concerned with so-called twin fuel injectors which are adapted to inject two different grades of fuel sequentially through the same injection nozzle.

In large diesel engines, such as those used for ship propulsion, heavy oil is used as a fuel as this is available at relatively low cost. The combustion characteristics of heavy oils are such that a delay period occurs between the fuel's injection into the cylinder and the start of combustion. This is an undesirable characteristic since it means that a relatively large volume of fuel is present in the cylinder when combustion starts and the rate of pressure rise in the cylinder is thus very high. This in turn means that high noise levels are emitted and high levels of stress are generated in the components of the engine.

A known solution to this problem is to use the pilot injection of a small quantity of fuel before the main fuel charge is injected. It is known that the same fuel can be used for the pilot and main injections through a single injector. It is also known that the pilot injection is more effective if a higher grade fuel is used for the pilot injection. A known method of achieving this is to pump the pilot fuel into the injector using a secondary pumping system as described in EP-A-0282819.

EP-A-0282819 discloses a fuel injector comprising a body defining a Rain fuel supply passage and a pilot fuel supply passage which communicate with the injection nozzle directly and via a non-return valve respectively. The main fuel supply passage is supplied with the main fuel by a conventional fuel injection pump and the pilot fuel supply passage communicates with a pilot fuel pump via a solenoid valve which is controlled by a complex timing control system.

The construction disclosed in this prior specification is complex bulky and expensive due to the necessity of providing the solenoid valve and the associated control system. Furthermore a second high pressure injection pump is required for the pilot fuel in addition to the usual high pressure injection pump required for the main fuel.

It is the object of the present invention to provide a fuel injector which is capable of injecting two different fuels sequentially and which overcomes the problems referred to above and which, in particular, requires only one high pressure injection pump and no control valve or control system to control the injection of the pilot fuel.

According to the present invention a fuel injector for use in a diesel engine adapted to inject two different fuels sequentially of the type comprising a body including an injection nozzle defining one or more injection orifices, a main fuel supply passage and a pilot fuel supply passage, which includes a first non-return valve arranged to prevent fuel flowing in it away from the injection nozzle, the nozzle being controlled by a valve needle which affords a surface directed towards the injection orifice(s) and exposed to a fuel supply gallery is characterised in that the body contains a cylinder which slidably receives a piston, that the main fuel passage communicates with the cylinder adjacent one end thereof, that the pilot fuel passage communicates with the cylinder adjacent the other end thereof and with a first outlet passage which communicates with the fuel gallery and includes a second non-return valve arranged to prevent fuel flowing from the fuel gallery into the pilot fuel passage and that a second outlet passage is provided which communicates with the fuel gallery and with the cylinder at a point intermediate its ends, whereby the main fuel passage communicates with the fuel gallery via the cylinder and the second outlet passage when the piston is at the said other end of the cylinder but not when it is at the said one end of the cylinder.

In use, the main fuel supply passage will be connected to a substantially conventional high pressure fuel injection pump whose outlet pressure varies cyclically but the pilot fuel supply passage need be connected only to a relatively low pressure pump whose output pressure may be substantially constant. The pilot fuel, which could conceiveably be the same as the main fuel but is preferably a higher grade fuel of lower flashpoint than the main fuel, flows under relatively low pressure through the pilot fuel supply passage into the cylinder below the piston whilst the latter moves towards that end of the cylinder with which the main fuel passage communicates. As the pressure produced by the main fuel injection pump increases the piston is progressively forced towards the other end of the cylinder thereby expelling the pilot fuel. The pilot fuel is prevented from flowing back to the pilot fuel pump by the first non-return valve and therefore flows through the first outlet passage and the second non-return valve to the fuel gallery. The pressure of the pilot fuel acts on the surface of the valve needle which is directed towards the injection nozzle and urges the needle away from the nozzle, that is to say into the open position. When the force exerted on the needle exceeds that exerted on it in the closing direction by the spring which is conventionally provided the needle moves into the open position and injection of the pilot fuel commences. The piston moves progressively along the length of the cylinder and uncovers the port by which the second outlet passage communicates with the cylinder. This places the main fuel passage in communication with the second outlet passage and the main fuel then flows through a portion of the cylinder into the second outlet passage and thence to the fuel gallery. The piston therefore now stops moving and substantially no further pilot fuel is injected and injection of the main fuel commences. Return of the residual pilot fuel from the first outlet passage to the cylinder is prevented by the second non-return valve When the pressure produced by the main fuel injection pump begins to drop again the valve needle is urged back into the closed position by its return spring and injection is terminated. When the force exerted on the piston by the main fuel drops below that exerted on the other end of the piston by the pilot fuel, and also by the piston return spring if one is provided, the piston is returned to its initial position whilst the space beneath it is filled with pilot fuel and the cycle is then repeated.

Accordingly, in the fuel injector in accordance with the present invention no solenoid valve or associated control system is required for the injection of the pilot fuel and the pressure required to inject the pilot fuel is provided by the main fuel injection pump. Only one high pressure pump is thus required. The relative timing of the pilot and main fuel injection is provided by the piston/cylinder arrangement.

As mentioned above, a spring or like return means may be provided within the cylinder to bias the piston towards the said one end of the cylinder. This is however not essential and required only if the pressure produced by the pilot fuel supply pump is less than the minimum output pressure of the main fuel injection pump. If a spring is not provided, however, it may be necessary to include a third non-return valve in the second outlet passage to prevent fuel from flowing from the low pressure supply through the gallery to the cylinder when the piston is at the other end of the cylinder.

As mentioned above, the valve needle will usually include a return spring to urge it towards the closed position and the end of the return spring remote from the injection nozzle may bear against a surface with the interposition of one or more adjustment shims. Variation in the number or thickness of these shims will vary the force exerted by the spring on the valve needle and thus the pressure at which the valve needle will open and close.

Variation of the number or thickness of the adjustment shims necessitates removal of the fuel injector from the engine in which it is used and complete disassembly of the fuel injector and this is therefore relatively time consuming and means that the engine cannot be used for a significant period of time. These disadvantages can be overcome if the cylinder is defined by a block which is movable within the fuel injector body and if the end of the spring remote from the injection nozzle bears against the block and if adjustment means actuable from the exterior of the fuel injector body act on the block to enable the position thereof relative to the injection nozzle to be adjusted. Thus operation of the adjustment means will result in movement of the block and thus in a variation in the spring force. This may be effected from the exterior of the fuel injector body and can thus be done without removing the fuel injector from the engine or disassembling it. The fact that the cylinder is defined by a movable block will not alter its operation but means do of course have to be provided to ensure that the ports in its walls, which move when the block is moved, still communicate with the various passages, which are of course fixed within the fuel injector body. For this purpose, the movable block may be slidably received in a sleeve in which the various passages are formed and provided that the passages, or at least that end of each passage which is adjacent the block, are larger, at least in the direction of movement of the block, than the ports in the block it can be assured that each port always communicates with the associated passage within the anticipated range of movement of the block.

In all the embodiments referred to above the injection of the pilot fuel will be followed by the injection of the main fuel with substantially no time gap between them. It may however be desirable in certain circumstances for the injection of the pilot fuel to be followed by a delay period before the injection of the main fuel commences and this may be achieved if the piston and the cylinder are of stepped shape with a larger diameter at the said one end than at the said other end and if the second outlet passage communicates with that portion of the cylinder which is of larger diameter. The stepped shape of the piston results in a pressure amplification across it which in turn means that during the injection of the pilot fuel the pressure of the pilot fuel is higher than that of the main fuel by a factor which is substantially equal to the ratio of the areas of the two portions of the piston. When the main fuel passage begins to communicate with the second outlet passage the pressure in the fuel gallery will suddenly drop from the higher pressure of the pilot fuel to the lower pressure of the main fuel and this will result in the valve needle moving into the closed position. However, the pressure of the main fuel progressively rises and after a certain time interval again exceeds the value at which the valve needle opens and injection of the main fuel then commences.

Further features and details of the invention will be apparent from the following description of certain specific embodiments of twin fuel injectors in accordance with the invention which is given with reference to the accompanying diagrammatic drawings, in which.

Figure 1:
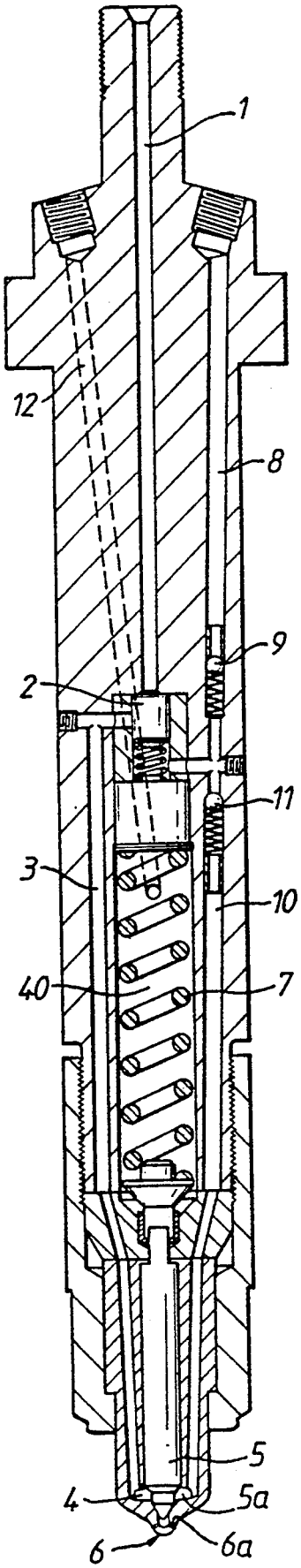
FIG. 1 is a sectional elevation of the first embodiment of injector.

FIG. 1 shows a fuel injector which is intended to be mounted in one cylinder of a large diesel engine. The fuel injector includes a body which defines a main fuel supply passage 1 which begins at one end of the body and terminates in a cylindrical space 13 which slidably receives a movable piston 2 which is biased upwardly, that is to say towards the end of the main fuel passage 1, by a spring 14. Communicating with the side of the cylinder 13 via a port 34 at a point below the end of the main fuel passage 1 is a passage 3 which terminates in an annular fuel gallery 4 adjacent the lower end of the fuel injector body. The lower end of the body is provided with an injection nozzle 6 affording one or more orifices 6*a* which communicate with a common discharge passage within the nozzle with which a needle 5 cooperates. The needle 5 has a downwardly directed shoulder 5*a*, exposed to the gallery 4 and is movable between an upper open position in which the gallery 4 communicates with the orifices 6a and a lower closed position in which it does not and the needle tip seals the discharge passage. The needle 5 is biased towards the closed position by a spring 7 accommodated within a chamber 13.

The injector body also defines a pilot fuel supply passage 8 which communicates via a non-return valve 9 with the lower portion of the cylindrical space 13, i.e. at a point below the piston 2 when the latter is in its uppermost position, and with the fuel gallery 4 via a further non-return valve 11 in a passage 10. In this case the passages 8 and 10 communicate directly but their communication could be indirect, i.e. via the cylindrical space 13. The non-return valves are in this case of spring loaded ball and seat type but other types may readily be used. A bleed line 12 communicates with the spring chamber and, in use permits pressure to be vented to the lower pressure side of the main fuel supply system.

In use, the supply passage 1 is connected to a conventional fuel injection pump (not shown) which is arranged to supply the main fuel, e.g. heavy diesel oil with a relatively low cetane number, and whose output pressure rises cyclically to a high pressure and then decreases again and the supply passage 8 is connected to a pump (not shown) arranged to supply the pilot fuel, that is to say a higher grade fuel with a higher cetane number, at a relatively low and constant pressure.

Figure 2:
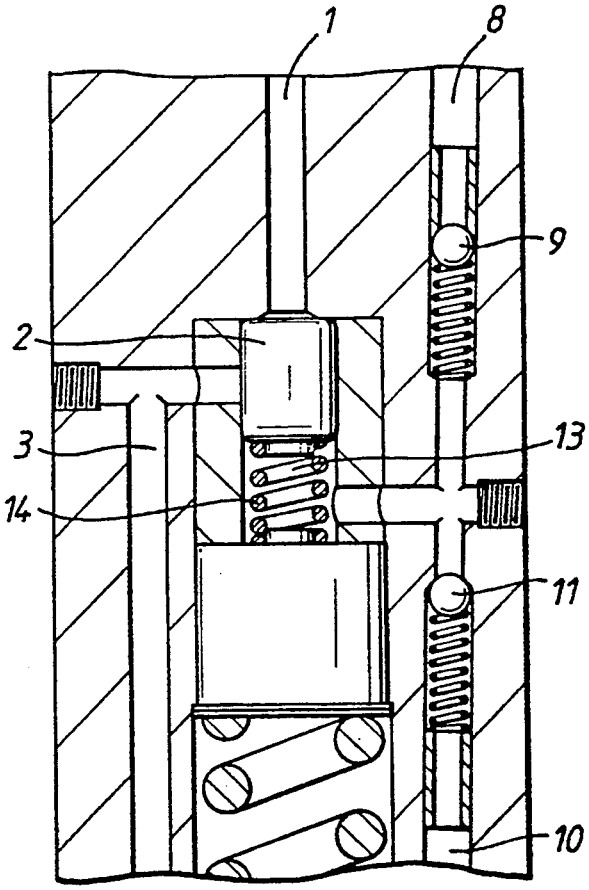
FIG. 2 is an enlarged scrap sectional view of the central part of the injector before the start of injection.

The operation of the fuel injector will now be explained with reference to FIGS. 2,3 and 4: initially, as seen in FIG. 2, the piston 2 is at its uppermost position and the pressure in the main fuel supply passage is relatively low. The cylinder 13 is full of pilot fuel due to the fact that the non-return valve 9 had previously opened under the pressure of the pilot fuel in the passage 8 thereby permitting the pilot fuel to flow into the cylinder 13, whilst the piston was moved upwardly by the spring 14 and the pressure in the passage 8, but not into the passage 10 due to the higher pressure in that passage holding the non-return valve 11 closed.

Figure 3:
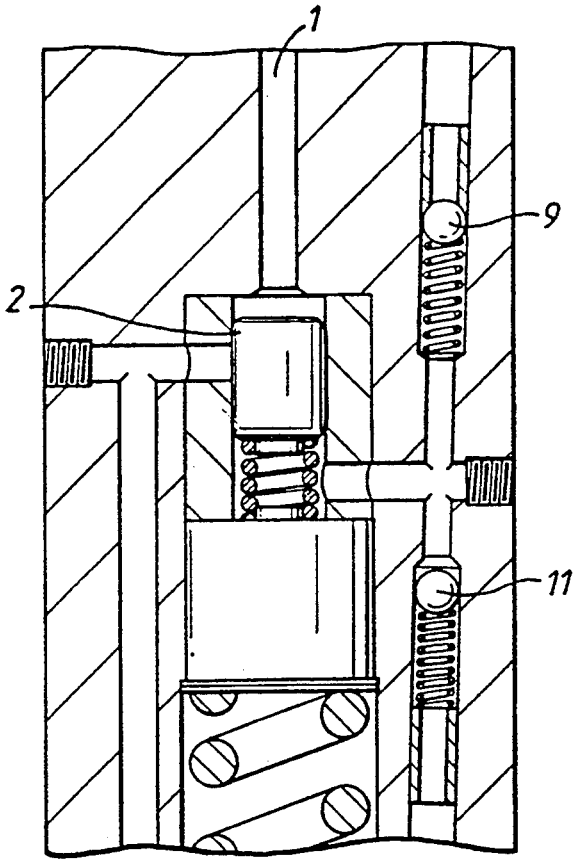
FIG. 3 is a view similar to FIG. 2 during the downward stroke of the piston.

FIG. 3 illustrates a later stage in the cycle in which the pressure produced by the main fuel pump begins to rise. The piston 2 is therefore caused to move downwardly thereby pressurising the pilot fuel in the cylinder 13. The pilot fuel can not flow back into the passage 8 due to the non-return valve 9 but the non-return valve 11 is caused to open thereby transmitting the pressure to the passage 10. This pressure acts on the shoulder 5a on the needle 5 and causes the needle to move into the open position against the force of the spring 7. The pilot fuel is then injected through the nozzle 6 and this injection continues while the piston 2 continues to move downwardly. The pilot fuel is ignited in the associated cylinder by the usual diesel ignition process.

Figure 4:
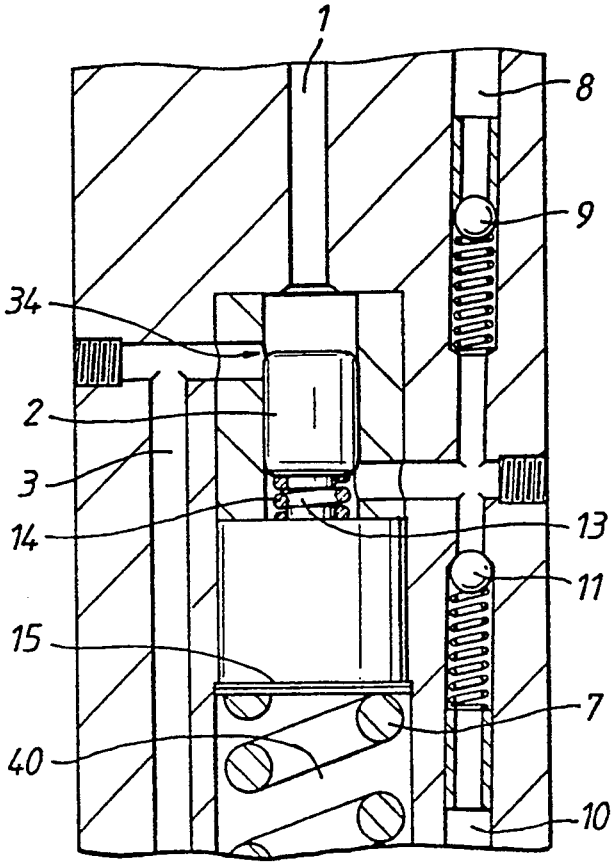
FIG. 4 is a further view similar to FIG. 2 at or near the completion of the downward stroke of the piston.

As shown in FIG. 4, after the piston 2 has moved down a certain distance the port 34 is uncovered and the main fuel can flow directly through the upper portion of the cylinder 13 and the port 34 into the passage 3 whence it is injected through the orifices 6*a*. The main fuel injected into the cylinder is promptly ignited by the combustion of the pilot fuel. The pressures on the two sides of the piston 2 are now substantially equal and its movement is terminated, either by friction or by the spring 14. The non-return valve 11 closes due to the fact that there is no pressure differential across it and the piston 2 is thus prevented from returning to its upper position since no fuel can enter the lower portion of the cylinder 13. When the injection period is complete, the pressure in the main fuel passage 1 progressively decreases. When it reaches a level where it is exceeded by the combination of the pressure of the spring 14 and the pressure in passage 8 it moves upwards until it reaches its uppermost position, shown in FIG. 2. As it moves upwardly, pilot fuel flows into the cylinder 13 and the cycle is complete.

Figure 5:
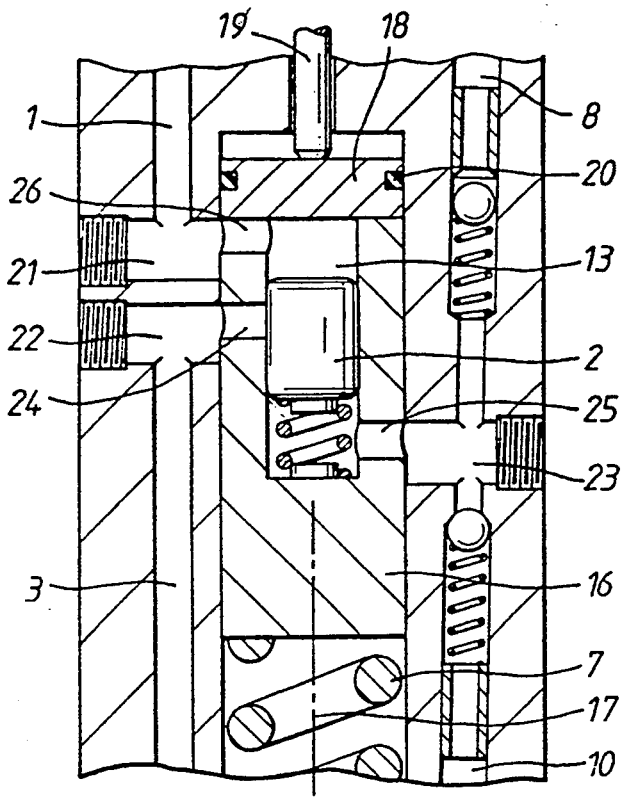
FIG. 5 is a view similar to FIG. 4 showing a second embodiment of the invention.

It is known that the pressure at which the injection of fuel occurs is very critical to the performance of an engine and that this pressure is determined principally by the force of the needle return spring, in this case the spring 7. A known method of adjusting this force is to fit shims 15 into the end of the spring chamber 40. This can only be achieved by removing the injector from the engine and by dismantling the injector. In cases where adjustment of the spring force must be achievable with the injector in the assembled condition, the embodiment of FIG. 5 is advantageous.

This embodiment is generally similar to that described above but the main fuel passage 1 communicates with the upper end of the cylinder 13 through a port 26 which is of smaller area than a short passage 21 which connects it to the passage 1. The passages 3 and 8 communicate with the cylinder 13 via ports 24 and 25, respectively, which are also of smaller area than respective short connecting passages 22 and 23. The cylinder 13 is not stationary but is formed in a movable block 16 against whose underside the needle spring 7 bears and against whose upper surface bears a disc 8 which seals the top of the cylinder 13 and is in turn sealed with respect to the sides of a cavity receiving the block 16 by an annular seal 20 or the like. Communicating centrally with the top of the cavity is an elongate passage which lies on the injector axis 17 and which receives an adjuster, in this case a threaded bolt 19, which bears against the disc 18 and may be rotated to move the block 16 with or against the resilience of the spring 7 and thus to alter the spring force and thus also the fuel pressure at which the injection of fuel commences.

Figure 6:
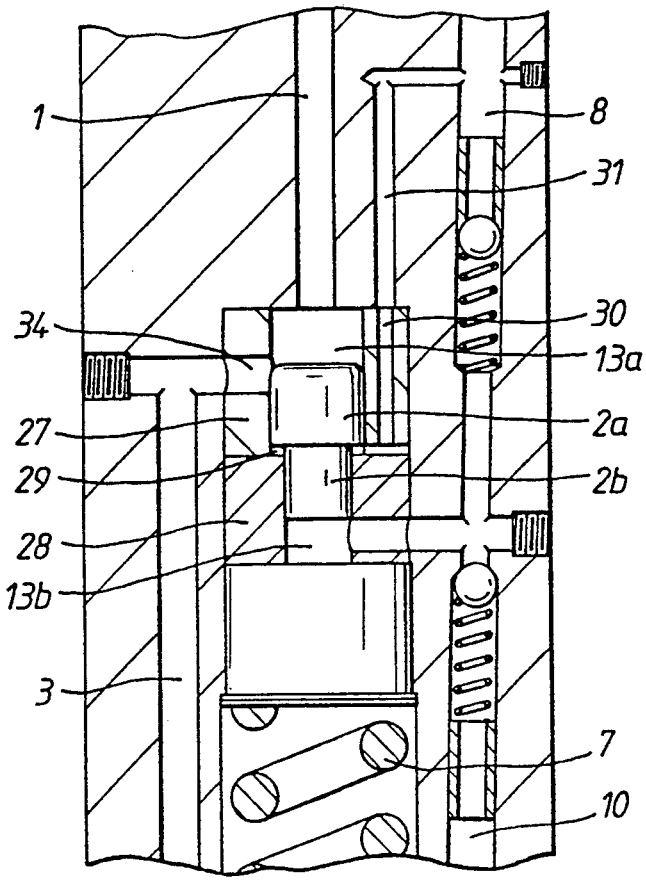
FIG. 6 is a further view similar to FIG. 4 showing a third embodiment of the invention.

In both the embodiments described above, the injection of the twin fuels occurs in a single continuous process with a discrete transition period from the pilot fuel to the main fuel. However, it may be advantageous as regards combustion to provide a time interval between the injection of the two fuels and this is provided by the embodiment of FIG. 6. This embodiment is again generally similar to that of FIGS. 1 to 4 but the piston is of stepped diameter and is constituted by two portions 2*a* and 2*b*, of which the lower portion 2*b* is of smaller diameter. The cylinder in which it is received is of correspondingly stepped shape and is constituted by two portions 13*a* and 13*b*. That portion 29 of the cylinder portion 13*a* which is defined by the lower surface of piston portion 2*a*, the upper surface of the wall 28 of cylinder portion 13*b*, the outer surface of piston portion 2*b* and the inner surface of the wall 27 of the cylinder portion 13*a* communicates with the pilot fuel supply passage 8 via passages 30 and 31 which act as a vent. When the pressure in the main fuel passage begins to increase, the differential areas of the piston portions produces a pressure amplification and a higher pressure is produced in cylinder portion 13*b*. These pressures increase until the injection pressure is reached in cylinder portion 13*b* and this occurs earlier in the cycle than in the previous embodiments due to the pressure amplification. When the port 34 is opened by the piston 2*a*,2*b*, passage 1 communicates with passages 3 and 10 and the pressure in the latter passages drops abruptly to that in passage 1 and the needle 5 is returned to the closed position by the spring 7 and injection is terminated. However, the pressure in passage 1 continues to rise and when it reaches the injection pressure fuel injection recommences. After injection has terminated, the pressure in passage 1 falls progressively. When the combined effects of the force of the spring 14 and the pressures in cavities 29 and 13*b* exceed the force due to the pressure in cavity 13*a*, the piston 2*a*,2*b* begins to move upwardly and the cylinder portion 13*b* refills with pilot fuel.

In the embodiments described above the quantity of pilot fuel injected per cycle is constant and determined by the volume of the cylinder 13. If it is desired to reduce the volume of pilot fuel injected, for instance with reduction in engine load, this may be achieved by limiting the trabel-of the piston 2, e.g. by hydraulic or mechanical means linked to the fuel pump control system.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patents of the United States is:

1. A fuel injector for use in a diesel engine adapted to inject two different fuels sequentially, said fuel injector comprising a body including an injection nozzle, said nozzle defining one or more injection orifices, a main fuel supply passage and a pilot fuel supply passage which includes a first non-return valve arranged to prevent fuel flowing in it away from said injection nozzle, said nozzle being controlled by a valve needle which affords a surface directed towards said injection orifice(s) and exposed to a fuel supply gallery, said body containing a cylinder which has two ends and slidably receives a piston, said main fuel passage communicating with said cylinder adjacent one of said ends, said pilot fuel passage communicating with said cylinder adjacent the other of said ends and with a first outlet passage which communicates with the fuel gallery and includes a second non-return valve arranged to prevent fuel flowing from said fuel gallery into said pilot fuel passage, said fuel injector further comprising a second outlet passage which communicates with said fuel gallery and with said cylinder at a point intermediate said ends, whereby said main fuel passage communicates with said fuel gallery via said cylinder and said second outlet passage when said piston is at the said other end of said cylinder but not when it is at said one end of said cylinder.

2. A fuel injector as claimed in claim 1 wherein a spring is provided which biases said piston towards said one end of said cylinder.

3. A fuel injector as claimed in claim 1 including a return spring which urges said valve needle towards the closed position and whose end remote from said injection nozzle bears against a surface with the interposition of one or more adjustment shims.

4. A fuel injector as claimed in claim 1 including a return spring which urges said valve needle towards the closed position, a block which defines said cylinder and which is movable within said body, the end of said spring remote from said injection nozzle bearing against said block and adjustment means which are actuable from the exterior of said body and which act on said block to enable the position thereof relative to said injection nozzle to be adjusted.

5. A fuel injector as claimed in claim 1 wherein said piston and said cylinder are of stepped shape with a larger diameter at said one end than at said other end and said second outlet passage communicates with that portion of said cylinder which is of larger diameter.

* * * * *